US012416208B1

(12) United States Patent
Luo et al.

(10) Patent No.: US 12,416,208 B1
(45) Date of Patent: Sep. 16, 2025

(54) ROBOTIC SYSTEM FOR CONTINUOUS CIRCULATION FOR A DRILLING OPERATION

(71) Applicant: Halliburton Energy Services, Inc., Houston, TX (US)

(72) Inventors: Yan Luo, Frisco, TX (US); Adan H. Herrera, Carrollton, TX (US); Kenneth Douglas Cope, Highland Village, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/784,785

(22) Filed: Jul. 25, 2024

(51) Int. Cl.
*E21B 21/01* (2006.01)

(52) U.S. Cl.
CPC ..... *E21B 21/019* (2020.05)

(58) Field of Classification Search
CPC ..... E21B 21/019
See application file for complete search history.

(56) References Cited

U.S. PATENT DOCUMENTS

| | | | | |
|---|---|---|---|---|
| 9,057,235 | B2 | 6/2015 | Blue et al. | |
| 9,725,971 | B2 | 8/2017 | Yajure et al. | |
| 10,344,547 | B2 | 7/2019 | Leuchtenberg et al. | |
| 10,794,130 | B2 | 10/2020 | Johnson et al. | |
| 11,365,592 | B1 * | 6/2022 | Moon | E21B 19/14 |
| 11,473,409 | B2 | 10/2022 | Al-mousa et al. | |
| 11,591,863 | B2 | 2/2023 | Basile et al. | |
| 11,708,729 | B2 | 7/2023 | Mccormick et al. | |
| 11,713,652 | B1 * | 8/2023 | Jamison | E21B 21/08 166/250.01 |
| 12,012,852 | B1 * | 6/2024 | Tonner | E21B 21/066 |
| 2014/0224509 | A1 * | 8/2014 | Yajure | E21B 19/165 166/380 |

(Continued)

FOREIGN PATENT DOCUMENTS

WO 2016097967 A1 6/2016

OTHER PUBLICATIONS

Halliburton Energy Services, Inc., "e-cd Plus System", Product Sheet available at https://www.halliburton.com/en/products/halliburton-continuous-circulation-systems, 2021, 2 pages.

(Continued)

*Primary Examiner* — Shane Bomar
(74) *Attorney, Agent, or Firm* — Kilpatrick Townsend & Stockton LLP

(57) ABSTRACT

A system can include a continuous circulation subcomponent, a robotic device, and a control system. The subcomponent can include a receiving area and can be associated with a drilling operation for forming a wellbore. The robotic device can include an end effector that can include a sensing device and tools corresponding to operations to facilitate continuous circulation in the wellbore. The control system can cause the robotic device to perform operations. The robotic device can align the end effector with the receiving area. The robotic device can determine whether a leak is present at the receiving area. The robotic device can connect, disconnect, or a combination thereof the diversion line with the receiving area to allow the continuous circulation during the drilling operation.

20 Claims, 6 Drawing Sheets

(56) References Cited

U.S. PATENT DOCUMENTS

| | | | | |
|---|---|---|---|---|
| 2015/0240582 | A1* | 8/2015 | Bansal | E21B 21/106<br>175/218 |
| 2021/0301606 | A1* | 9/2021 | Mikalsen | E21B 21/01 |
| 2022/0025742 | A1* | 1/2022 | Al-Mousa | E21B 4/02 |
| 2022/0290515 | A1* | 9/2022 | Hasler | E21B 21/08 |

OTHER PUBLICATIONS

Jixiang et al., "Design and Simulation Study on Continuous Circulation Valve Drilling System", Institute of Physics Publishing Conference Series Earth and Environmental Science, vol. 242, Issue 3, 2019, 12 pages.

* cited by examiner

ROBOTIC SYSTEM FOR CONTINUOUS CIRCULATION FOR A DRILLING OPERATION

TECHNICAL FIELD

The present disclosure relates generally to wellbore operations and, more particularly (although not necessarily exclusively), to a robotic system that can be used to facilitate continuous circulation during a wellbore drilling operation.

BACKGROUND

Wellbore operations may include various equipment, components, methods, or techniques to perform various tasks with respect to a wellbore, such as fluid control. In some examples, the wellbore operations may involve a drilling operation such as active wellbore drilling, tripping in, tripping out, and the like. During a drilling operation, mud and other fluid may be circulated, such as by pumping the mud or other fluid into a wellbore being formed, out of a wellbore being formed, etc., with respect to the wellbore being formed. As the wellbore is being formed, new piping or other material may be attached to a drill string or other component of the drilling operation to continue the drilling operation. Attaching the new piping or other material, for example without interrupting the drilling operation, may be difficult.

DETAILED DESCRIPTION

Figure 1:
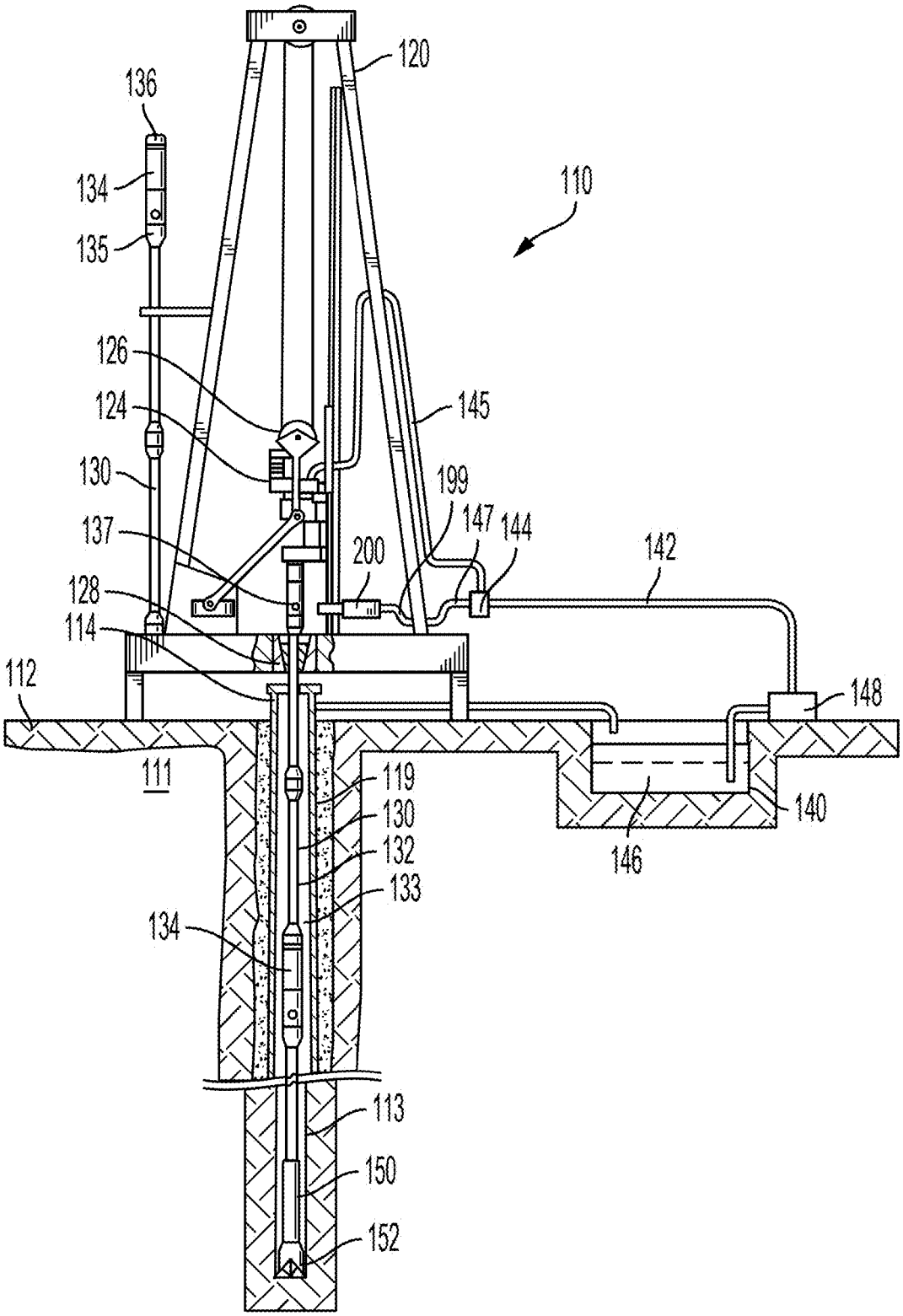
FIG. 1 is a diagram of a continuous circulation drilling system according to some aspects of the present disclosure.

Certain aspects and examples of the present disclosure relate to a robotic system that can be used to facilitate continuous circulation for a drilling operation. The drilling operation can be or include an active drilling operation, a tripping in operation, a tripping out operation, or any other suitable operation involving a wellbore being formed. Continuous circulation can involve circulating fluid, such as mud or other material, into, out of, or within the wellbore without interrupting or otherwise stopping the drilling operation. For example, the continuous circulation can involve continuing to circulate the fluid while new piping or other new material is being coupled with or otherwise added to a drill string being used to form the wellbore. The robotic system can facilitate the continuous circulation. For example, the robotic system can include a robotic device, such as a robotic arm, and an end effector that can include a set of tools that can be used to enable the continuous circulation. Enabling the continuous circulation may involve diverting a source of the fluid circulating with respect to the wellbore from a main source to a diversion source that can circulate the fluid with respect to the wellbore and allow new piping or other new material to be coupled with or otherwise added to the drill string.

Continuous circulation in a drilling operation can be a technique used, for example with respect to managed pressure drilling (MPD), to maintain flow down a drill pipe while making a connection, thereby maintaining equivalent circulating density (ECD) and keeping a constant pressure profile in well annulus to prevent an influx of formation fluids or potential hole collapse due to instability. In other drilling operations, the drilling fluid may not keep circulating in the process of drill pipe connection, so the cuttings cannot be transported continuously. With continuous circulation, there may be no interruption to the flow of drilling fluid into the well throughout the process of adding drill pipe joints to, or removing drill pipe joints from, the drillstring. Continuous circulation drilling can provide a downhole, steady-state condition, and the formations may not suffer from pressure oscillations while hole-cleaning and borehole stability improve. Additionally or alternatively, the risk of drilling issues related to bottom hole pressure management in open holes can be mitigated or eliminated.

A continuous circulation system can enable continuous circulation during a drill pipe connection process for drilling and tripping narrow-pressure window wells and providing continuous hole cleaning, among other suitable operations relating to drilling. The continuous circulation system can include a set of components, which may include a diversion manifold and a continuous circulation subcomponent. While the continuous circulation subcomponent can be integrated with a drillstring of the drilling operation, the manifold can be connected to a rig standpipe to divert flow from a top drive to a side port of the subcomponent through a diversion flow line, or vice versa. During continuous circulation, a set of steps can be performed to connect a diversion flow line from the manifold to the side port of the subcomponent and to disconnect after the circulation is done. Other systems for performing a subset of the set of steps rely on manual operations and expose operators and equipment to enhanced risk of damage, injury, and the like. The manual operations can involve connection and disconnection of the diversion flow line.

A robotic continuous circulation system can be used to automatically connect and disconnect the diversion flow line to the side port of the subcomponent to allow a fully automated continuous circulation process. The robotic continuous circulation system can include a robotic device such as a robotic arm. During the continuous circulation process, the robotic device can connect or disconnect the diversion flow line from the manifold to or from the side port of the subcomponent. The robotic device can include one or more robotic arms that can be installed on the rig floor. Additionally or alternatively, each robotic arm can include an end effector that can have a manipulation toolset and a sensing device. The manipulation toolset can include a set of tools for manipulating the connection or disconnection of the diversion flow line, and the sensing device may include a camera or a position sensor that can be used to guide the end effector to the subcomponent.

In some examples, using the robotic continuous circulation system can cause improvements to be made over other drilling systems. The improvements can include:

- maintaining formation integrity and borehole stability by reducing ballooning effects and pressure cycling on the well by removing pumps-on and pumps-off conditions.
- extending a life of a bottom-hole assembly of the drilling operation by maintaining the dynamic well temperature.
- reducing transitional errors during drill pipe connection by lessening the need for human intervention.
- preventing mud rheology or composition changes by maintaining a constant flow of fluid.
- reducing connection gas and any other negative side effects by stopping and restarting flow.
- improving the rate of penetration (ROP) through continuous hole cleaning.

During continuous circulation, a first step may involve using the robotic continuous circulation system to connect a diversion flow line from the manifold to the side port of the subcomponent. After the circulation is complete, the robotic continuous circulation system can perform another step to disconnect the diversion flow line and resume the regular operation such as drilling or tripping. The above-mentioned steps may each have one or more sub-steps and may be automatically performed, such as without human intervention once initiated, in series such as with a set of tools positioned on the end effector of the robotic device.

The robotic device of the robotic continuous circulation system can be integrated the with a toolset and diversion flow line. For example, a particular tool of the toolset can be connected with the diversion flow line. The robotic device can bring the toolset, or the end effector that includes the toolset, near the subcomponent based on predefined position parameters, data gathered by the sensing device, or a combination thereof. A control system can be included in the robotic continuous circulation system and can include a robot controller in communication with the robotic device to control the robotic device. The robotic continuous circulation system can make a connection and can disconnect of diversion flow line based on an analysis of image data to determine the location and orientation of the subcomponent, or any other component thereof, and to transmit the location and orientation of the subcomponent, or any other component thereof, to the robot controller.

The toolset, which may be or may be included with the end effector, can include multiple tools to perform certain steps or operations related to connecting and disconnecting the diversion line with respect to the subcomponent. One tool included in the toolset may include a tool to loosen a bleeder valve to check a sealing condition of a flapper included in the subcomponent. The tool can also determine or can be used to determine if there is a leakage behind a safety plug of the subcomponent. Leakage or no leakage can be confirmed with data gathered, for example, by the sensing device. If there is no leakage, a second tool included with the toolset can be aligned to remove the safety plug and retain the safety plug. After removing the safety plug, the diversion flow line can be aligned and installed, for example by using a third tool included with the toolset. The diversion manifold can be operated to start the flow diversion. Upon completing the flow diversion, the above sequence of steps can be reversed to remove the diversion flow line, to install the safety plug, and to tighten the bleeder valve. In some examples, rotation movement by the robotic device operating the toolset can be driven by a motor associated with the robotic device. In some examples, each tool included in the toolset may be able to perform one operation or more than one operation. For example, one example of a tool can interact with a valve, can detect a leak or pressure, or a combination thereof.

The sensing device can include one or more cameras on the toolset and may capture images, or other position data, of an object. The sensing device can identify features, such as hardware shape, position, etc., on the subcomponent and can determine the location and orientation of the features to manipulate the robotic arm and the toolset for engagement. While loosening the bleeder valve for leakage checking, techniques such as image comparison or motion detection can be used to determine if there is a leakage, to determine a magnitude of any detected leakage, and the like.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of a continuous circulation drilling system 100 according to some aspects of the present disclosure. The continuous circulation drilling system 110 may include a derrick or drilling rig 120, which may be located on land, for example as illustrated, or atop an offshore platform, semi-submersible, drill ship, or any other platform capable of forming a wellbore 113 through one or more downhole formations 111. The continuous circulation drilling system 110 may be used in vertical wells, non-vertical or deviated wells, multilateral wells, offshore wells, etc.

The continuous circulation drilling system 110 may include a top drive 124, a hoist 126, other equipment necessary for drilling the wellbore 113, or any combination thereof. Additionally or alternatively with respect to the top drive 124, a rotary table 128 may be provided. The drilling rig 120 may be located generally above a well head 114, which in the case of an offshore location is located at the sea bed and may be connected to the drilling rig 120 via a riser or other suitable connection feature.

The drilling rig 120 may be used to carry a drill string 132, which may be assembled from individual lengths or stands of connected lengths of drill pipe 130 that may be run at least partially into the wellbore 113. In some examples, the wellbore 113 may be completed or may be in a process of being formed). The drill string 132 may include standard drill pipe, heavy-wall drill pipe, drill collars, coiled tubing, or any suitable combination thereof. The wellbore 113 may be at least partially lined with casing 119 along a length of the wellbore 113. In some examples, the drill string 132 may include one or more continuous circulation subcomponents, such as the continuous circulation subcomponent 134, along a length of the drill string 132, which may have intervals between individual lengths or stands of the drill pipe 130.

A lower end of the drill string 132 may include a bottom hole assembly 150, which may carry a rotary drill bit 152 at a distal end of the bottom hole assembly 150. The bottom hole assembly 150 may include one or more drill collars, stabilizers, reamers, a downhole mud motor, rotary steerable device and various other tools such as those that can provide logging or measurement data and other information from the bottom of, or any other location with respect to, the wellbore 113. Measurement data and other information may be communicated from bottom hole assembly 150 using measurement while drilling techniques and can be converted to electrical signals at the well surface 112 to, among other things, monitor the performance of the drill string 132, the bottom hole assembly 150, and the associated rotary drill bit 152.

An interior of the drill string 132 can define an axially extending conduit. An annulus 133 can be defined between the drill string 132 and a wall of the wellbore 113. During drilling operations, a mud pump 148 may provide a drilling fluid 146 or other well treatment fluid such as weighted drilling mud, a cement slurry, a displacement fluid, a completion fluid, a stimulation fluid, a gravel pack fluid, and the like, from a mud pit 140, through the interior of drill string 132, through the bottom hole assembly 150, to exit through nozzles within rotary drill bit 152. The drilling fluid 146 may then mix with formation cuttings and other downhole fluids and debris. The annulus 133 may provide a flow path for the drilling fluid to be returned to the mud pit 140 at the surface 112. Various types of screens, filters, centrifuges, and the like may be provided to remove formation cuttings and other downhole debris prior to returning drilling fluid to recirculation by the mud pump 148.

The continuous circulation subcomponent 134 can allow the drilling fluid 146 to be circulated through the wellbore 113 to continue without interruption during the operational steps for making or breaking connections of the drill string 132 at the rig floor. In some examples, the continuous circulation subcomponent 134 can include a tubular body with pin and box connectors 135 and 136 at opposite ends for connection along the drill string 132. Additional or alternative and suitable connector types may be used for the drill string 132. In some examples, the continuous circulation subcomponent 134 may be a unitary subcomponent or may be an assembly of discrete subcomponents. In a particular example, the continuous circulation drilling system 110 may use an individual continuous circulation subcomponent connected atop each drill pipe 130 as the stand is being made up to or removed from the drill string 132. The tubular body of the continuous circulation subcomponent 134 may define an axial flow path between connectors 135 and 136. An axial flow valve can be disposed within the continuous circulation subcomponent 134, and the axial flow valve can act as a one-way check valve that allows flow in one direction such as a downhole direction. In some examples, the axial valve may be a swing check flapper valve, although other types of valves may be used as appropriate.

The continuous circulation drilling system 110 may operate to maintain continuous circulation in the wellbore 113. For example, and during drilling operations, which may include an active drilling operation, a tripping operation, etc., the drill string 132 can be lowered into wellbore 113 via a hoist 126 and rotated by the top drive 124 or the rotary table 128. Drilling fluid can be supplied by the mud pump 148 via a flow line 142, a flow manifold 144, a hose 145, and the top drive 124 or a fluid swivel to the axial flow path through a top connector, such as connector 136 of the continuous circulation subcomponent 134. An axial valve of the continuous circulation subcomponent 134 can be opened, and a radial valve of the continuous circulation subcomponent 134 can be shut. Fluid can flow out of a bottom connector, such as the connector 135, into the interior of the drill string 132.

Lowering and rotating the drill string 132 may be temporarily ceased when the continuous circulation subcomponent 134 reaches the level of the drilling rig floor. The drill string 132 may be held by slips within the rotary table 128. A robotic continuous circulation system 200 can be used with respect to the continuous circulation subcomponent 134 at the elevation of side port 137. The robotic continuous circulation system 200 may, for example using an end effector that includes a set of different tools, automatically check the leakage within the side port 137 between a bleeder valve and a safety plug, may automatically remove the safety plug from the side port 137, and may automatically attach a diversion flow line 199 into the side port 137. The flow manifold 144 may then be operated to divert drilling fluid flowing through the hose 145 and the connector 136 into the axial flow path of the continuous circulation subcomponent 134 to a hose 147 and the diversion flow line 199 into the side port 137 of the continuous circulation subcomponent 134. The pressure differential within the continuous circulation subcomponent 134 can operate to shut the axial valve and open the radial valve within continuous circulation subcomponent 134. The robotic continuous circulation system 200 can be used to disconnect the diversion flow line 199 from the continuous circulation subcomponent 134 once the drill string 132 has been augmented with an additional drill pipe or for other suitable reasons. The robotic continuous circulation system 200 can disconnect the diversion flow line 199 using the same or similar tools with respect to connecting the diversion flow line 199 to the continuous circulation subcomponent 134.

Figure 2:
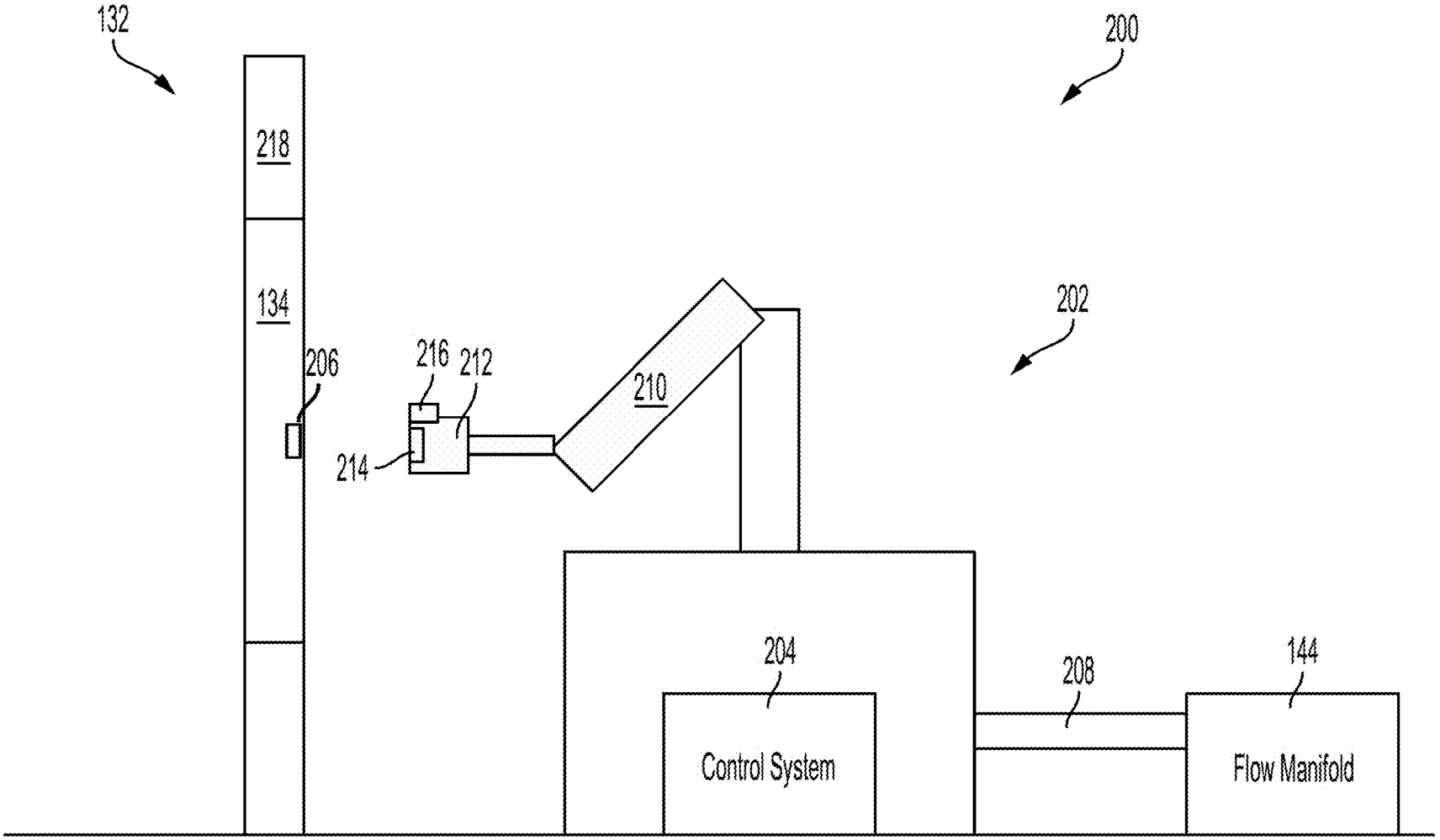
FIG. 2 is a block diagram of a robotic continuous circulation system that can facilitate continuous circulation for a drilling operation according to some aspects of the present disclosure.

FIG. 2 is a block diagram of a robotic continuous circulation system 200 that can facilitate continuous circulation for a drilling operation according to some aspects of the present disclosure. As illustrated in FIG. 2, the robotic continuous circulation system 200 can include the flow manifold 144, a robotic device 202, the continuous circulation subcomponent 134, and a control system 204. The robotic continuous circulation system 200 may include additional, alternative, or fewer components.

The continuous circulation subcomponent 134 may be positioned on the drill string 132 that can be run in the wellbore 113 for forming the wellbore 113 or for other suitable purposes. The continuous circulation subcomponent 134 may include a receiving area 206, such as the side port 137, that can be sized to receive a diversion line 208 such as the diversion flow line 199. In some examples, the receiving area 206 may include a safety plug, a bleeder valve, and other components to facilitate continuous circulation, and associated operations, for a drilling operation involving the drill string 132. The bleeder valve can allow leaks to be detected in the continuous circulation subcomponent 134 without causing damage to the drill string 132 or the robotic continuous circulation system 200. The safety plug may be removed to allow the diversion line 208 to be attached, such as via the robotic device 202, to the continuous circulation subcomponent 134 at the receiving area 206. In some examples, the diversion line 208 may extend from the flow manifold 144 to the robotic device 202, or any component thereof such as the end effector 212 or any tools of the set of tools 214 positioned on the end effector 212.

The robotic device 202 can be or include a robotic arm 210 that can include a SCARA robot, a Cartesian robot, and the like. In some examples, the robotic device 202 can include the robotic arm 210 and an end effector 212 that can be positioned on a distal end of the robotic arm 210 to allow the robotic device 202 to interact with the continuous circulation subcomponent 134 or other suitable components associated with the drill string 132. The robotic device 202 may include the control system 204, may be communicatively coupled with the control system 204, or may be in any other suitable configuration with respect to the control system 204. As illustrated, the robotic device 202 includes the control system 204, but in other examples, the control system 204 may be separated from the control system 204 and may be communicatively coupled with the control system 204 to allow the control system 204 to control the robotic device 202. In some examples, controlling the robotic device 202 can involve determining a trajectory for moving the robotic device 202, determining a force applied by the robotic device 202, control of a motor for moving or adjusting an orientation of the end effector 212, or any tools thereof, and the like.

The end effector 212 may be positioned on an end of the robotic device 202 proximate to the continuous circulation subcomponent 134 when the continuous circulation subcomponent 134 is positioned on a rig floor to facilitate continuous circulation. In some examples, the end effector 212 can include a set of tools 214 and a sensing device 216, though the end effector 212 can include any additional, alternative, or fewer components to provide functionality for the robotic device 202. The set of tools 214 can include more than one tool to allow the end effector to perform more than one operation without changing hardware or a configuration of the robotic device 202. In some examples, each tool included in the set of tools 214 may be capable of performing one operation or more than one operation. In a particular example, the set of tools 214 can include three tools that can each interact with, or otherwise be positioned at, the receiving area 206 of the continuous circulation subcomponent 134. The three tools can include a first tool for checking for a leak in the continuous circulation subcomponent 134, can include a third tool for removing a safety plug to access the receiving area 206 of the continuous circulation subcomponent 134, and can include a second tool coupled with the diversion line 208. The second tool can be connected to the receiving area 206 to at least temporarily affix the diversion line 208 to the receiving area 206 of the continuous circulation subcomponent 134 to allow fluid to flow from the diversion line 208 into the continuous circulation subcomponent 134 and into the wellbore 113.

The sensing device 216 can be or include a camera, a laser sensor, a position sensor, or other suitable device that can record and transmit position data about the end effector 212, the receiving area 206 of the continuous circulation subcomponent 134, or a combination thereof. For example, the sensing device 216 can be a camera that can record locations of the end effector 212 and the receiving area 206 of the continuous circulation subcomponent 134 while the robotic continuous circulation system 200 is in operation. The sensing device 216 may provide recorded data to the control system 204 that can use the data from the sensing device 216 to control the robotic device 202, for example by adjusting a trajectory or motor speed associated with the robotic device 202.

In some examples, the robotic continuous circulation system 200 can be used to facilitate a continuous circulation operation with respect to a drilling operation using the drill string 132. The robotic continuous circulation system 200 can perform a set of operations to determine that the continuous circulation subcomponent 134 is safe to open, to access the continuous circulation subcomponent 134, and to connect the diversion line 208 to the continuous circulation subcomponent 134. By connecting the diversion line 208 to the continuous circulation subcomponent 134, a section of new piping 218 can be added to the drill string 132 to allow the drill string 132 to go further into the wellbore 113 and to avoid pausing fluid circulation with respect to the wellbore 113.

Figure 3:
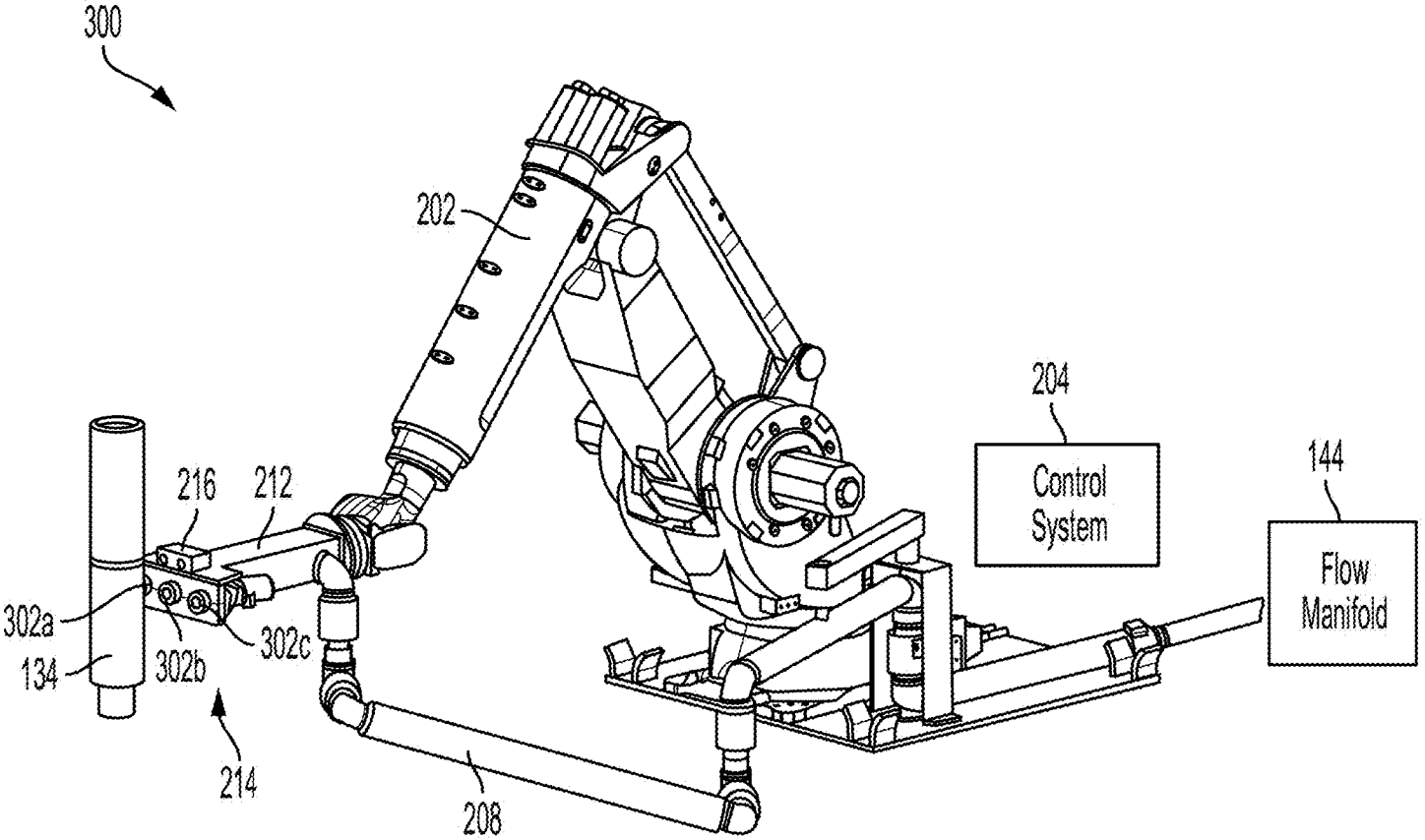
FIG. 3 is a perspective view of a robotic continuous circulation system that can facilitate continuous circulation for a drilling operation according to some aspects of the present disclosure.

FIG. 3 is a perspective view of a robotic continuous circulation system 200 that can facilitate continuous circulation for a drilling operation according to some aspects of the present disclosure. As illustrated in FIG. 3, the robotic continuous circulation system 200 can include the robotic device 202, the flow manifold 144, the control system 204, and the continuous circulation subcomponent 134. The robotic continuous circulation system 200 may include additional, alternative, or fewer components than are illustrated in FIG. 3.

The robotic continuous circulation system 200 can be used to divert flow of fluid in the wellbore 113 using the flow manifold 144. For example, the diversion line 208 can be affixed to the continuous circulation subcomponent 134 by the robotic continuous circulation system 200 to divert fluid from being received upstream of the drill string 132 to being received via the diversion line 208, for example to allow additional pipe sections to be added to the drill string 132 or for other suitable purposes. The robotic continuous circulation system 200 may use the robotic device 202 to perform a set of operations for connecting the diversion line 208 to the continuous circulation subcomponent 134 or for disconnecting the diversion line 208 from the continuous circulation subcomponent 134.

The robotic device 202 may include the end effector 212, which may include the set of tools 214 and the sensing device 216. The robotic continuous circulation system 200 can gather data about continuous circulation subcomponent 134, such as a location of the receiving area 206, a type of hardware used to seal the receiving area 206, etc., using the sensing device 216 and can provide the gathered data to the control system 204 to control the robotic device 202. Controlling the robotic device 202 can involve controlling each tool of the set of tools 214 or any subset thereof. As illustrated in FIG. 3, the set of tools 214 can include a first tool 302*a*, a second tool 302*b*, and a third tool 302*c*. The first tool 302*a* can be or include a tool to detect pressure or leaks that may be present in the continuous circulation subcomponent 134. The third tool 302*c* may be or include a tool for removing a safety plug from the continuous circulation subcomponent 134 to provide access to the continuous circulation subcomponent 134 such as via the receiving area 206. The second tool 302*b* may be or include a tool that can be connected to the diversion line 208 and that can affix the diversion line 208 to the receiving area 206 of the continuous circulation subcomponent 134. The first tool 302*a*, the second tool 302*b*, and the third tool 302*c* may be or include any other suitable tool for facilitating operations to affix the diversion line 208 to the continuous circulation subcomponent 134 or to otherwise facilitate continuous circulation in the wellbore 113.

Figure 4:
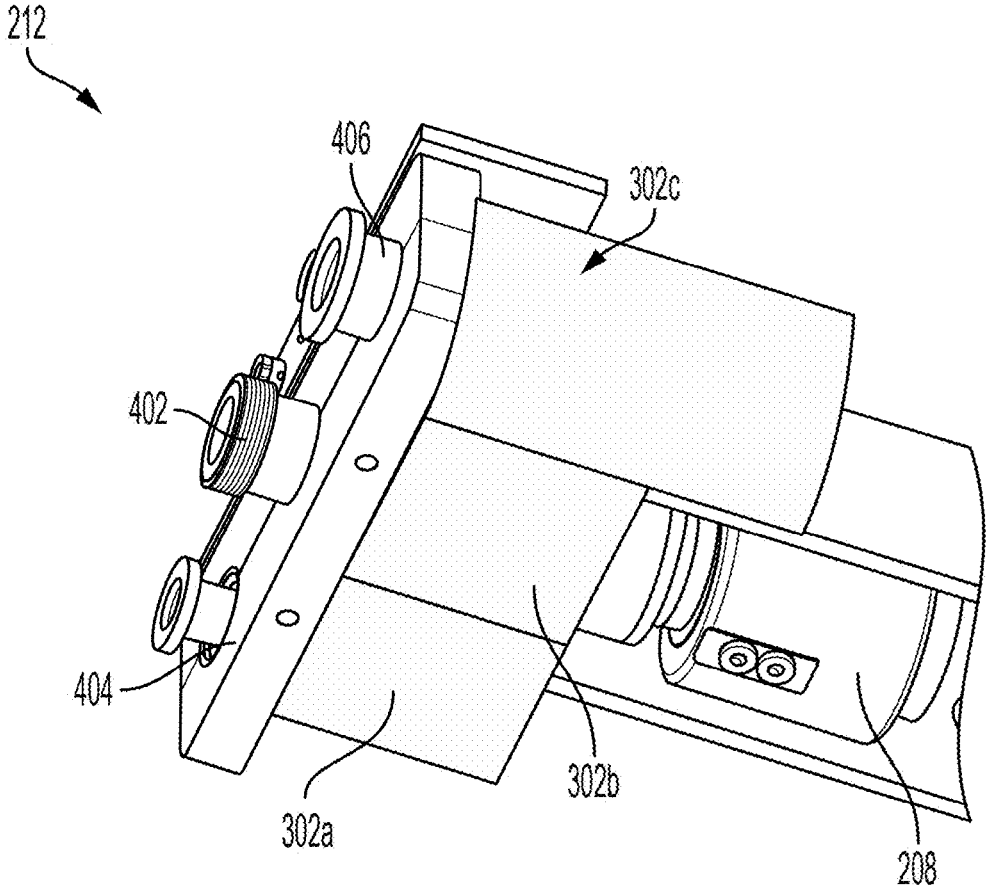
FIG. 4 is a bottom-perspective view of an end effector of a robotic continuous circulation system that can facilitate continuous circulation for a drilling operation according to some aspects of the present disclosure.

FIG. 4 is a bottom-perspective view of an end effector 212 of a robotic continuous circulation system 200 that can facilitate continuous circulation for a drilling operation according to some aspects of the present disclosure. The end effector 212 may be coupled with the robotic device 202 and may be controlled by the control system 204 or other suitable control module. Additionally or alternatively, each tool illustrated on the end effector 212 may be powered via an electrical motor, a pneumatic motor, or other suitable motors that can provide power to the tools of the end effector 212. For example, each tool included on the end effector 212 may have a different motor or a distinct but similar motor to provide functionality to the tool.

As illustrated in FIG. 4, the end effector 212 can include the set of tools 214 that can include the first tool 302*a*, the second tool 302*b*, and the third tool 302*c*, though the set of tools 214 may include any other suitable number (e.g., less than three or more than three) of tools. In some examples, the first tool 302*a*, the second tool 302*b*, the third tool 302*c*, or any combination thereof, can be or include a screwdriver, wrench, a ratchet, or other tool that can provide functionality for the robotic continuous circulation system 200. The tools included in the set of tools 214 may be specially designed or adapted for use on the end effector 212. For example, if the first tool 302*a* is a wrench, the first tool 302*a* may be a modified wrench head that does not include a handle and that simply includes a wrench head sized to interact with a specific component of the continuous circulation subcomponent 134.

As illustrated in FIG. 4, the set of tools 214 are spaced apart horizontally from one another in a configuration in which the end effector 212 is interacting with the receiving area 206. For example, the set of tools 214 may be arranged, from left to right, as the first tool 302*a*, the second tool 302*b*, and then the third tool 302*c*. Other configurations, such as vertically spaced apart, radially arranged, and other configurations, are possible. Additionally or alternatively, the sensing device 216 may be positioned above the set of tools 214 in a configuration in which the end effector 212 is interacting with the receiving area 206. The sensing device 216 may be otherwise suitable arranged with respect to the set of tools 214 to provide sensing functionality for the robotic continuous circulation system 200 or any component thereof.

In some examples, the diversion line 208 can be coupled with at least one tool of the set of tools 214. As illustrated in FIG. 4, a first end 402 of the diversion line 208 can be coupled with the second tool 302*b*, though in other examples, the diversion line 208 can be coupled with other tools of the set of tools 214. The first end 402 can be connected to the receiving area 206 to at least temporarily affix the diversion line 208 to the continuous circulation subcomponent 134. Additionally or alternatively, prior to at least temporarily affixing the diversion line 208 to the continuous circulation subcomponent 134, a first end 404 of the first tool 302*a* and a first end 406 of the third tool 302*c* may be used to prepare the receiving area 206 of the continuous circulation subcomponent 134 for the first end 402. For example, the first end 404 can be used to check whether a leak exists in the continuous circulation subcomponent 134 by opening a bleed valve, and the first end 406 can be used to remove a safety plug from the receiving area 206 to provide a surface for the first end 402 to couple with the continuous circulation subcomponent 134. Other operations and configurations for the set of tools, and ends thereof, can be performed or used with respect to the end effector 212.

Figure 5:
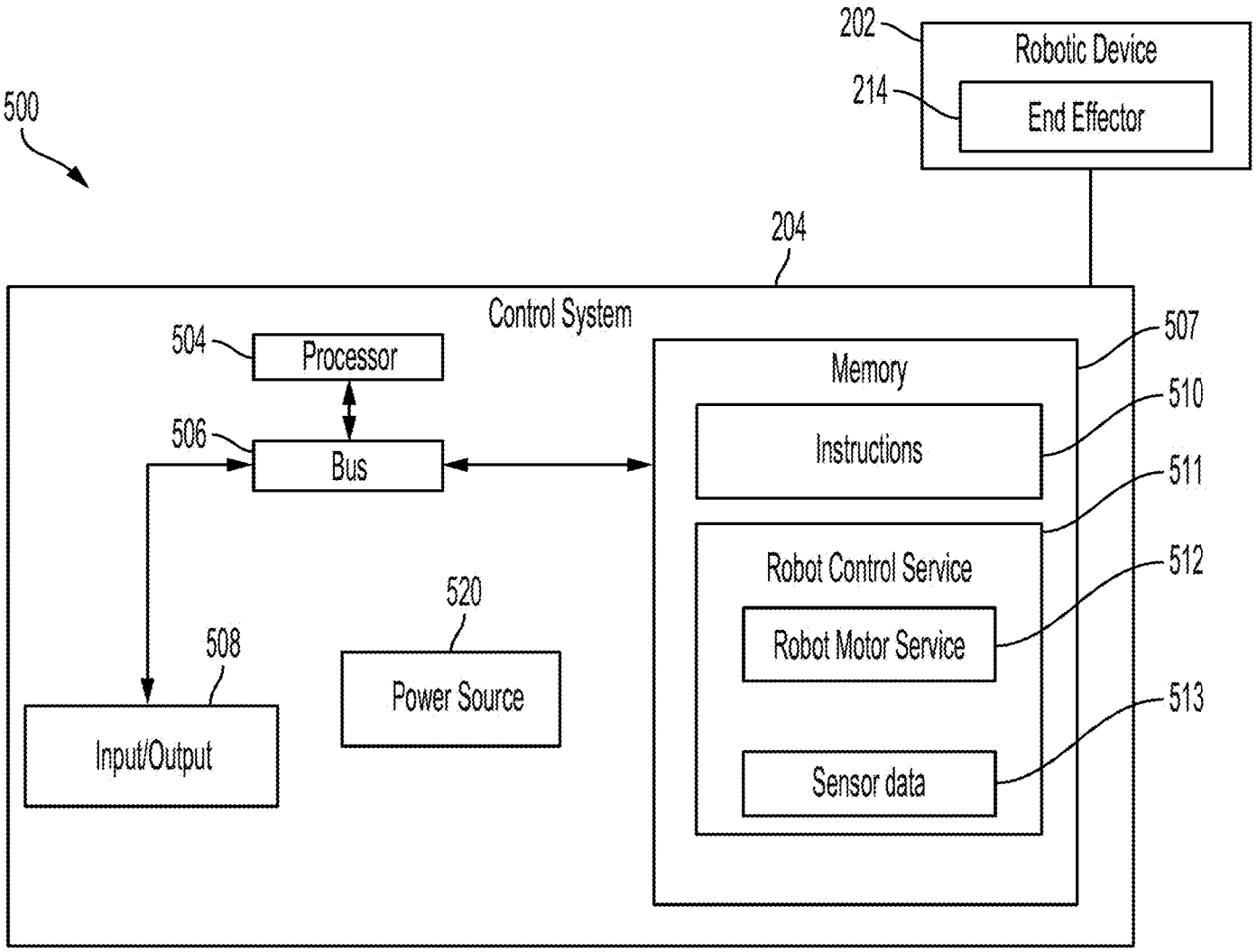
FIG. 5 is a block diagram of a computing system that can be used with a robotic continuous circulation system that can facilitate continuous circulation for a drilling operation according to some aspects of the present disclosure.

FIG. 5 is a block diagram of a computing system 500 that can be used with a robotic continuous circulation system 200 that can facilitate continuous circulation for a drilling operation according to some aspects of the present disclosure. The components, such as processor 504, memory 507, power source 520, input/output 508, and so on, illustrated in FIG. 5, may be integrated into a single structure such as within a single housing of the control system 204 and in communication with the robotic device 202. In some examples, the components illustrated in FIG. 5 can be distributed from one another and may be in electrical communication with each other. And, in other examples, the computing system 500 may be integrated into the robotic device 202, or vice versa.

The control system 204 can include the processor 504, the memory 507, and a bus 506, among other suitable components for the control system 204. The processor 504 can execute one or more operations for performing a set of operations for facilitating continuous circulation in the wellbore 113. The processor 504 can execute computer-program instructions 510 stored in the memory 507 to perform the set of operations. The processor 504 can include one processing device or multiple processing devices or cores. Non-limiting examples of the processor 504 can include a field-programmable gate array ("FPGA"), an application-specific integrated circuit ("ASIC"), a microprocessor, and the like.

The processor 504 can be communicatively coupled with the memory 507 via the bus 506. The memory 507 may be or include non-volatile memory and may include any type of memory device that retains stored information when powered off. Some examples of non-volatile forms of the memory 507 may include EEPROM, flash memory, or any other type of non-volatile memory. In some examples, at least part of the memory 507 can include a medium from which the processor 504 can read computer-program instructions 510. A computer-readable medium can include electronic, optical, magnetic, or other storage devices capable of providing the processor 504 with computer-readable instructions or other program code. Some examples of a computer-readable medium may include magnetic disk(s), memory chip(s), ROM, RAM, an ASIC, a configured processor, optical storage, or any other medium from which a computer processor can read computer-program instructions 510. The computer-program instructions 510 can include processor-specific instructions generated by a compiler or an interpreter from code written in any suitable computer-programming language, including, for example, C, C++, C#, Perl, Java, Python, etc.

In some examples, the memory 507 can be a non-transitory computer readable medium and can include computer-program instructions 510. The computer-program instructions 510 can be executed by the processor 504 for causing the processor 504 to perform the set of operations. For example, the processor 504 can execute a robot control service 511, and the like to provide functionality for the control system 204, the robotic device 202, or the like. For example, the processor 504 can cause sensor data 513, such as position data, to be gathered by the robotic device 202 such as via the sensing device 216. Additionally or alternatively, the processor 504 can execute a robot motor service 512 to cause the robotic device 202, or any component thereof such as the end effector 212, to be translated or otherwise moved to align the end effector 212 with the continuous circulation subcomponent 134, or the receiving area 206 thereof. Additionally or alternatively, the processor 504 can execute the robot control service 511 to perform a set of operations for causing the robotic device 202 to interact with the continuous circulation subcomponent 134 for facilitating continuous circulation in the wellbore 113.

The control system 204 can additionally include an input/output 508. The input/output 508 can connect to a keyboard, a pointing device, a display, other computer input/output devices or any combination thereof. An operator may provide input using the input/output 508. In some examples, the control system 204 may be fully autonomous and may function without input from an operator. Data relating to the wellbore 113, the continuous circulation subcomponent 134, the robotic continuous circulation system 200, the drilling operation, or any combination thereof can be displayed to an operator of a wellbore operation through a display that is connected to or is part of the input/output 508. The displayed values can be observed by the operator, or by another suitable user, of the wellbore operation, who can adjust the wellbore operation based on the output. Additionally or alternatively, the control system 204 can automatically control or adjust the wellbore operation, which may be or include a drilling operation, based on the output.

Figure 6:
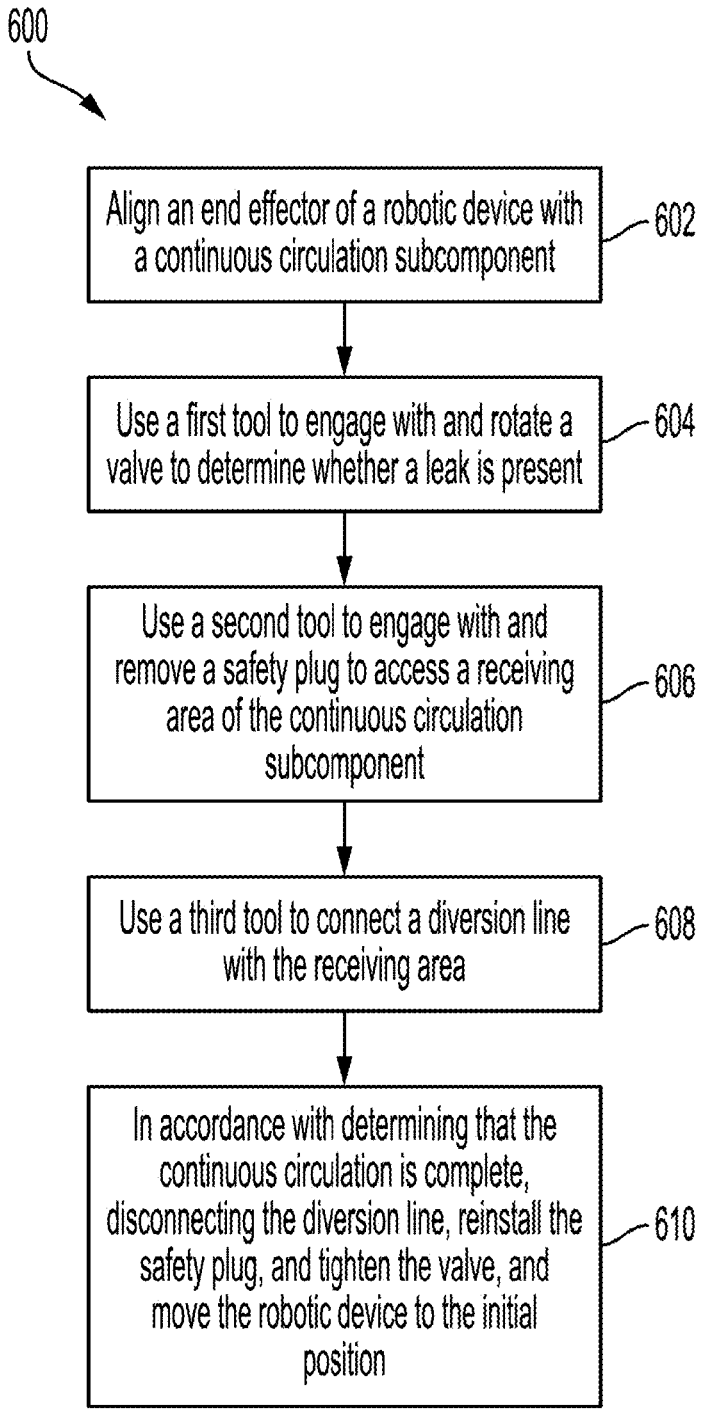
FIG. 6 is a flowchart of a process for using a robotic continuous circulation system to facilitate continuous circulation for a drilling operation according to some aspects of the present disclosure.

FIG. 6 is a flowchart of a process 600 for using a robotic continuous circulation system 200 to facilitate continuous circulation for a drilling operation according to some aspects of the present disclosure. At block 602, an end effector 212 is aligned with a receiving area 206 of a continuous circulation subcomponent 134. The end effector 212 may be positioned on or otherwise coupled with the robotic device 202 and may include a set of tools 214 and a sensing device 216. The end effector 212 may be aligned by the control system 204 and based on data gathered by the sensing device 216. In some examples, the control system 204 may cause the end effector 212 to be positioned within a predetermined area proximate to an expected location of the continuous circulation subcomponent 134. After the end effector 212 is positioned in the predetermined area, the sensing device 216 may gather position data, image data, or other suitable data about the end effector 212, about the continuous circulation subcomponent 134, or the receiving area 206 thereof, or any combination thereof. The sensing device 216 can provide the gathered data to the control system 204, which can use the gathered data to make one or more fine adjustments to an alignment of the end effector 212. The fine adjustments to the end effector 212 may cause the end effector 212, or the set of tools 214 thereof, to be aligned with the receiving area 206. In some examples, the end effector 212 being aligned with the receiving area 206 may involve the end effector 212 being in a position to interact or engage with the receiving area 206 to perform a set of operations with the set of tools 214.

At block 604, a first tool of the set of tools 214 is used to engage with a valve positioned at the receiving area 206. In some examples, the first tool can engage with the valve by physically interlocking with the valve and rotating the valve a predetermined amount to perform a first particular operation. The first particular operation may include determining whether a leak is present at the receiving area 206 or otherwise within the continuous circulation subcomponent 134. The valve may be or include a bleeder valve that, if a leak is present, may apply pressure on pressure sensor adjacent to the first tool or may otherwise be detected by the sensing device 216. In response to determining that a leak is present, the control system 204 may cause the first tool to tighten the valve and to take no further action until the continuous circulation subcomponent 134 is repaired or decommissioned. In some examples, if a leak is detected, a next continuous circulation subcomponent may be positioned on which for the robotic continuous circulation system 200 to operate. In response to detecting that no leak is present, the control system 204 may proceed in the process 600 by using a third tool to perform a second operation.

At block 606, the third tool of the set of tools 214 is used to engage with and remove a safety plug from the continuous circulation subcomponent 134 to provide access to the receiving area 206. In some examples, the third tool may be offset, such as horizontally offset, vertically offset, radially offset, etc., from the first tool, and the control system 204 may cause the end effector 212 to horizontally, vertically, or radially translate to align the third tool with the receiving area 206 or the safety plug installed thereon. In some examples, engaging the third tool with the safety plug may involve physically interlocking an end of the third tool with the safety plug and rotating the safety plug to remove the safety plug. In other examples, the safety plug can be removed through other interactions, such as lifting upward, pulling outward, etc., other than rotation. In response to removing the safety plug, the third tool may retain or otherwise hold on to the safety plug until the safety plug is used later in the process 600 or is otherwise used in other suitable processes.

At block 608, a second tool is used to connect the diversion line 208 with the receiving area 206. In some examples, the second tool may be offset, such as horizontally offset, vertically offset, radially offset, etc., from the first tool, from the third tool, or from a combination thereof. The control system 204 may cause the end effector 212 to horizontally translate, vertically translate, radially translate, or any combination thereof to cause the second tool to be aligned with the receiving area 206. In some examples, the second tool may be coupled with the diversion line 208. In a particular example, a first end of the second tool may be or include a female-type connector or a male-type connector that is sized to be affixed to the receiving area 206, and a second end of the second tool opposite the first end may be integrated with or otherwise coupled with the diversion line 208. Affixing the second tool to the receiving area 206, such as by screwing the second tool onto the receiving area 206, pressing the second tool into the receiving area 206, or other suitable mechanisms for affixing the second tool to the receiving area 206, can at least indirectly affix the diversion line 208 to the receiving area 206. For example, affixing the second tool to the receiving area 206 may allow fluid to flow from the diversion line 208, through the receiving area 206, and into the wellbore 113, for example without losing the fluid.

The diversion line 208 may be retained in the receiving area 206 for a predetermined amount of time or other suitable amount of time corresponding to an operation associated with continuous circulation in the wellbore 113. For example, the diversion line 208 may be retained as affixed to the receiving area 206 for an amount of time to allow additional pipe to be added upstream from the continuous circulation subcomponent 134 to the drill string 132.

At block 610, and in response to determining that an operation associated with continuous circulation in the wellbore 113 is complete, the above operations are performed in reverse. For example, the control system 204 may cause the second tool, and the diversion line 208, to be disconnected from the receiving area 206. Additionally or alternatively, the control system 204 may align the third tool with the receiving area 206 and may cause the third tool to reattach the safety plug to the receiving area 206. Additionally or alternatively, the control system 204 may align the first tool with the receiving area 206 and may cause the first tool to tighten the valve to allow the continuous circulation subcomponent 134 to receive fluid from upstream for circulation in the wellbore 113. In some examples, after removing at least the diversion line 208 from the receiving area 206, the robotic device 202 can clean, such as by spraying with detergent or water, the receiving area 206 or other portions of the continuous circulation subcomponent 134. Additionally or alternatively, the robotic device 202 can be moved to an initial position to await further instructions from the control system 204.

In some aspects, systems, methods, and robotic devices for continuous circulation for drilling operations are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a continuous circulation subcomponent comprising a receiving area for a diversion line for continuous circulation during a drilling operation involving a wellbore; a robotic device comprising one or more end effectors, the one or more end effectors comprising a sensing device and a plurality of tools corresponding to a plurality of operations to facilitate the continuous circulation; and a control system communicatively coupled with the robotic device to cause the robotic device to perform operations comprising: aligning at least one end effector of the one or more end effectors with the receiving area; determining whether a leak is present at the receiving area; and in accordance with a determination that the leak is not present, connecting the diversion line with the receiving area to allow the continuous circulation during the drilling operation.

Example 2 is the system of example 1, wherein the sensing device comprises a camera, a laser sensor, or a position sensor, and wherein the operation of aligning the at least one end effector with the receiving area comprises using position data from the camera, the laser sensor, or the position sensor to align the at least one end effector with the receiving area.

Example 3 is the system of example 1, wherein the plurality of tools comprises a first tool, a second tool, and a third tool, wherein the first tool is arranged on the at least one end effector to perform a first operation of the plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

Example 4 is the system of any of examples 1 or 3, wherein the first tool, the second tool, and the third tool are horizontally offset from one another when the at least one end effector is connected with the receiving area of the continuous circulation subcomponent, and wherein the sensing device is vertically offset from the plurality of tools when the at least one end effector is connected with the receiving area of the continuous circulation subcomponent.

Example 5 is the system of any of examples 1 or 3, wherein the first operation is the operation of determining whether the leak is present at the receiving area, wherein the third operation is removing a safety plug from the receiving area, and wherein the second operation is the operation of connecting the diversion line with the receiving area to allow the continuous circulation during the drilling operation.

Example 6 is the system of any of examples 1, 3, or 5, wherein the second tool is coupled with the diversion line, and wherein the second tool is couplable with the receiving area of the continuous circulation subcomponent to connect the diversion line with the continuous circulation subcomponent to allow the continuous circulation with respect to the wellbore.

Example 7 is the system of example 1, wherein the operation of connecting the diversion line with the receiving area to allow the continuous circulation during the drilling operation comprises retaining the at least one end effector at the receiving area while the diversion line is being used to facilitate the continuous circulation.

Example 8 is the system of any of examples 1 or 7, wherein the operations further comprise, in response to determining that the continuous circulation is complete, removing the diversion line from the receiving area with the at least one end effector.

Example 9 is a method comprising: aligning, by a control system of a robotic continuous circulation system that comprises a robotic device, at least one end effector of the robotic device with a receiving area of a continuous circulation subcomponent associated with a drilling operation to form a wellbore, the aligning based on data received from a sensing device positioned on the at least one end effector; determining, by the control system and using a first tool of a plurality of tools included in one or more end effectors that comprise the at least one end effector, whether a leak is present at the receiving area of the continuous circulation subcomponent; and in accordance with a determination that the leak is not present, and in response to using a third tool to access the receiving area, connecting, by the control system and using a second tool of the plurality of tools, a diversion line with the receiving area to allow continuous circulation in the wellbore during the drilling operation.

Example 10 is the method of example 9, wherein the sensing device comprises a camera, a laser sensor, or a position sensor, and wherein aligning the at least one end effector with the receiving area comprises using, by the control system, position data from the camera, the laser sensor, or the position sensor to align the at least one end effector with the receiving area.

Example 11 is the method of example 9, wherein the plurality of tools comprises the first tool, the second tool, and the third tool, wherein the first tool is arranged on the at least one end effector to perform a first operation of a plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

Example 12 is the method of any of examples 9 or 11, wherein the first operation is determining whether the leak is present at the receiving area, wherein the second operation is connecting the diversion line with the receiving area to allow the continuous circulation during the drilling operation, and wherein the third operation is removing a safety plug from the receiving area to access the continuous circulation subcomponent.

Example 13 is the method of any of examples 9 or 11-12, wherein the second tool is coupled with the diversion line, and wherein connecting the diversion line with the receiving area comprises affixing the second tool to the receiving area to couple the diversion line with the receiving area.

Example 14 is the method of example 9, wherein connecting the diversion line with the receiving area comprises retaining the at least one end effector at the receiving area while the diversion line is being used to facilitate the continuous circulation.

Example 15 is the method of any of examples 9 or 14, further comprising, in response to determining that the continuous circulation is complete, removing the diversion line from the receiving area with the at least one end effector.

Example 16 is a robotic device comprising: one or more end effectors comprising a sensing device and a plurality of tools corresponding to a plurality of operations to facilitate continuous circulation in a wellbore for a drilling operation; and a control system to cause the robotic device to perform operations comprising: aligning at least one end effector of the one or more end effectors with a receiving area of a continuous circulation subcomponent associated with the drilling operation; determining whether a leak is present at the receiving area; and in accordance with a determination that the leak is not present, connecting a diversion line with the receiving area to allow the continuous circulation during the drilling operation.

Example 17 is the robotic device of example 16, wherein the sensing device comprises a camera, a laser sensor, or a position sensor, and wherein the operation of aligning the at least one end effector with the receiving area comprises using position data from the camera, the laser sensor, or the position sensor to align the at least one end effector with the receiving area.

Example 18 is the robotic device of example 16, wherein the plurality of tools comprises a first tool, a second tool, and a third tool, wherein the first tool is arranged on the at least one end effector to perform a first operation of the plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

Example 19 is the robotic device of any of examples 16 or 18, wherein the first tool, the second tool, and the third tool are horizontally offset from one another when the at least one end effector is connected with the receiving area of the continuous circulation subcomponent, and wherein the sensing device is vertically offset from the plurality of tools when the at least one end effector is connected with the receiving area of the continuous circulation subcomponent.

Example 20 is the robotic device of example 16, wherein the operation of connecting the diversion line with the receiving area comprises retaining the at least one end effector at the receiving area while the diversion line is being used to facilitate the continuous circulation, and wherein the operations further comprise, in response to determining that the continuous circulation is complete, removing the diversion line from the receiving area with the at least one end effector.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a continuous circulation subcomponent comprising a receiving area for a diversion line for continuous circulation during a drilling operation involving a wellbore;

a robotic device comprising one or more end effectors, the one or more end effectors comprising a sensing device and a plurality of tools corresponding to a plurality of operations to facilitate the continuous circulation; and a control system communicatively coupled with the robotic device to cause the robotic device to perform operations comprising:

aligning at least one end effector of the one or more end effectors with the receiving area;

determining whether a leak is present at the receiving area; and in accordance with a determination that the leak is not present, connecting the diversion line with the receiving area to allow the continuous circulation during the drilling operation.

2. The system of claim 1, wherein the sensing device comprises a camera, a laser sensor, or a position sensor, and wherein the operation of aligning the at least one end effector with the receiving area comprises using position data from the camera, the laser sensor, or the position sensor to align the at least one end effector with the receiving area.

3. The system of claim 1, wherein the plurality of tools comprises a first tool, a second tool, and a third tool, wherein the first tool is arranged on the at least one end effector to perform a first operation of the plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

4. The system of claim 3, wherein the first tool, the second tool, and the third tool are horizontally offset from one another when the at least one end effector is connected with the receiving area of the continuous circulation subcomponent, and wherein the sensing device is vertically offset from the plurality of tools when the at least one end effector is connected with the receiving area of the continuous circulation subcomponent.

5. The system of claim 3, wherein the first operation is the operation of determining whether the leak is present at the receiving area, wherein the third operation is removing a safety plug from the receiving area, and wherein the second operation is the operation of connecting the diversion line with the receiving area to allow the continuous circulation during the drilling operation.

6. The system of claim 5, wherein the second tool is coupled with the diversion line, and wherein the second tool is couplable with the receiving area of the continuous circulation subcomponent to connect the diversion line with the continuous circulation subcomponent to allow the continuous circulation with respect to the wellbore.

7. The system of claim 1, wherein the operation of connecting the diversion line with the receiving area to allow the continuous circulation during the drilling operation comprises retaining the at least one end effector at the receiving area while the diversion line is being used to facilitate the continuous circulation.

8. The system of claim 7, wherein the operations further comprise, in response to determining that the continuous circulation is complete, removing the diversion line from the receiving area with the at least one end effector.

9. A method comprising:

aligning, by a control system of a robotic continuous circulation system that comprises a robotic device, at least one end effector of the robotic device with a receiving area of a continuous circulation subcomponent associated with a drilling operation to form a wellbore, the aligning based on data received from a sensing device positioned on the at least one end effector;

determining, by the control system and using a first tool of a plurality of tools included in one or more end effectors that comprise the at least one end effector, whether a leak is present at the receiving area of the continuous circulation subcomponent; and in accordance with a determination that the leak is not present, and in response to using a third tool to access the receiving area, connecting, by the control system and using a second tool of the plurality of tools, a diversion line with the receiving area to allow continuous circulation in the wellbore during the drilling operation.

10. The method of claim 9, wherein the sensing device comprises a camera, a laser sensor, or a position sensor, and wherein aligning the at least one end effector with the receiving area comprises using, by the control system, position data from the camera, the laser sensor, or the position sensor to align the at least one end effector with the receiving area.

11. The method of claim 9, wherein the plurality of tools comprises the first tool, the second tool, and the third tool, wherein the first tool is arranged on the at least one end effector to perform a first operation of a plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

12. The method of claim 11, wherein the first operation is determining whether the leak is present at the receiving area, wherein the second operation is connecting the diversion line with the receiving area to allow the continuous circulation during the drilling operation, and wherein the third operation is removing a safety plug from the receiving area to access the continuous circulation subcomponent.

13. The method of claim 12, wherein the second tool is coupled with the diversion line, and wherein connecting the diversion line with the receiving area comprises affixing the second tool to the receiving area to couple the diversion line with the receiving area.

14. The method of claim 9, wherein connecting the diversion line with the receiving area comprises retaining the at least one end effector at the receiving area while the diversion line is being used to facilitate the continuous circulation.

15. The method of claim 14, further comprising, in response to determining that the continuous circulation is complete, removing the diversion line from the receiving area with the at least one end effector.

16. A robotic device comprising:

one or more end effectors comprising a sensing device and a plurality of tools corresponding to a plurality of operations to facilitate continuous circulation in a wellbore for a drilling operation; and a control system to cause the robotic device to perform operations comprising:

aligning at least one end effector of the one or more end effectors with a receiving area of a continuous circulation subcomponent associated with the drilling operation;

determining whether a leak is present at the receiving area; and in accordance with a determination that the leak is not present, connecting a diversion line with the receiving area to allow the continuous circulation during the drilling operation.

17. The robotic device of claim 16, wherein the sensing device comprises a camera, a laser sensor, or a position sensor, and wherein the operation of aligning the at least one end effector with the receiving area comprises using position data from the camera, the laser sensor, or the position sensor to align the at least one end effector with the receiving area.

18. The robotic device of claim 16, wherein the plurality of tools comprises a first tool, a second tool, and a third tool, wherein the first tool is arranged on the at least one end effector to perform a first operation of the plurality of operations, wherein the second tool is arranged on the at least one end effector to perform a second operation of the plurality of operations, wherein the third tool is arranged on the at least one end effector to perform a third operation of the plurality of operations, and wherein the first operation, the second operation, and the third operation are different from one another.

19. The robotic device of claim 18, wherein the first tool, the second tool, and the third tool are horizontally offset from one another when the at least one end effector is connected with the receiving area of the continuous circulation subcomponent, and wherein the sensing device is vertically offset from the plurality of tools when the at least one end effector is connected with the receiving area of the continuous circulation subcomponent.

20. The robotic device of claim 16, wherein the operation of connecting the diversion line with the receiving area comprises retaining the at least one end effector at the receiving area while the diversion line is being used to facilitate the continuous circulation, and wherein the operations further comprise, in response to determining that the continuous circulation is complete, removing the diversion line from the receiving area with the at least one end effector.

* * * * *